US006432028B1

(12) United States Patent
Ortloff

(10) Patent No.: US 6,432,028 B1
(45) Date of Patent: Aug. 13, 2002

(54) LEVITATING EXERCISE WAND

(76) Inventor: Angel Ortloff, 392 Abbey Rd., Mt. Tremper, NY (US) 12457

( * ) Notice: Subject to any disclaimer, the term of this patent is extended or adjusted under 35 U.S.C. 154(b) by 0 days.

(21) Appl. No.: 09/507,658

(22) Filed: Feb. 22, 2000

Related U.S. Application Data

(63) Continuation of application No. 09/065,170, filed on Apr. 23, 1998, now abandoned.

(51) Int. Cl.[7] ..... A63B 15/00
(52) U.S. Cl. ..... 482/109; 482/148
(58) Field of Search ..... 482/148, 139, 482/77, 106, 92, 93, 110; 135/65; 446/236, 247, 215; D21/463, 465, 436, 455, 457, 461; 362/102; 84/477 B; 177/246; 663/47.2; 70/15

(56) References Cited

U.S. PATENT DOCUMENTS

| | | | | | |
|---|---|---|---|---|---|
| 4,253,673 | A | * | 3/1981 | Bailey | 273/428 |
| 5,087,220 | A | * | 2/1992 | Cotita | 446/247 |
| 5,403,256 | A | * | 4/1995 | Squires | 482/91 |
| 5,443,435 | A | * | 8/1995 | Wilkinson | 482/74 |
| 5,593,159 | A | * | 1/1997 | Otake | 463/47.2 |
| 5,938,532 | A | * | 8/1999 | Wall | 463/47.2 |

* cited by examiner

*Primary Examiner*—Justine R. Yu
(74) *Attorney, Agent, or Firm*—Billy J Knowles

(57) ABSTRACT

A levitating exercise wand and a method for use in therapy, exercise, and recreation is described. The method of use of a levitating exercise wand is to provide a therapeutic exercise subsequent to treatments of diseases such as lymphoma or during exercise therapy during treatment of concentration conditions such as attention deficit disorder. The levitating exercise wand has a rod having an attachment point such as a hole placed toward the upper end of the rod from the center of mass so as to maintain a vertical orientation when in motion. A string is attached to the rod and forms a closed loop. A first weight is placed at a lower end of the rod to transfer a center of gravity location. The first weight will allow the wand to have a more controlled motion rather than oscillating or vibrating in an uncontrolled fashion. The method of exercise employing a levitating exercise wand begins with holding an arm with elbow bent at waist level and hand faced such that an index finger is placed topmost with all other fingers extended parallel and a thumb vertical. The string is placed at a midpoint of said index finger. The arm is moved forward and backward in a U-shaped motion around an upper end of said levitating exercise wand. The hand is held level and maintains the levitating wand in a vertical position. The method of exercise may also employ dancing, and movements that will pass the levitating exercise wand around the body.

5 Claims, 2 Drawing Sheets

LEVITATING EXERCISE WAND

This application is a continuation of U.S. application Ser. No. 09/065,170, filed on Apr. 23, 1998, now abandoned.

BACKGROUND OF THE INVENTION

1. Field of the Invention

This invention relates to amusement and exercise devices, and more particularly to a levitating exercise wand and to the methods of use thereof to provide therapeutic and recreational exercise.

2. Description of Related Art

The use of wands and sticks in conjunction with recreational exercise is well known. U.S. Pat. No. 5,681,246 (Dougherty) describes a pivoting jump stick for use in areas with restricted overhead space. The pivoting jump stick will allow the user to create the types of exercise similar to those of the classical jump rope.

Variations of the wand and stick are shown in U.S. Pat. No. 5,244,445 (Amesquita) and U.S. Pat. No. 5,022,648 (Travis). In Amesquita, the wand is hollowed and filled with weighted spheres. The spheres move within the wand during exercise causing shifting of the mass and increased momentum of the end of the wand. This will cause fuller and more complete twisting of the torso during vigorous exercise.

Travis has incorporated a spring in the wand mechanism. The user will perform aerobic exercise by placing the wand behind the neck, grabbing the ends of the wand and bending the wand in a rowing motion.

Sticks and wands have been incorporated into dance routines and as such are well known in the art. An example of this is shown in U.S. Pat. No. 3,904,197 (Canoge). Canoge discloses poles for use in the traditional Tinikling or Philippine Stick Dance.

A levitating wand, as offered for sale under the registered trademark Zyberwand by David Horstman of France, shows a stick with an attached string. The Zyberwand is held over the middle finger of a hand. The wand is allowed to swing left and right and the operator will move his or her body to avoid the movement of the wand.

During therapy after treatments for such diseases as lymphoma or where a person may have had a radical mastectomy, exercise is crucial to the maintenance of circulation and strengthening of the affected muscles. In therapies for adults and children suffering from conditions such as attention deficit disorder, repetitious enjoyable activities develop and improve cognitive and concentration skills.

In the above described therapies, the exercise must be gentle and rhythmic to allow slow strengthening of damage tissues or strengthening of concentration.

SUMMARY OF THE INVENTION

An object of this invention is to provide an exercise wand for use in therapy, exercise, and recreation.

Another object of this invention is to provide a method for making an exercise wand that will permit repetitive manufacture of the exercise wand.

Further another object of this invention is a method of use of a levitating exercise wand to provide a therapeutic exercise subsequent to treatments of diseases such as lymphoma or during exercise therapy during treatment of concentration conditions such as attention deficit disorder.

To accomplish these and other objects a levitating exercise wand has a rod having an attachment point such as a hole placed from approximately 1.9 cm. to approximately 2.6 cm toward the upper end of the rod from the center of mass such that the rod will maintain a vertical orientation when in motion. The length of the rod will be from approximately 45 cm to approximately 125 cm. and have a diameter of from approximately 0.6 cm. to approximately 1.25 cm. A string is attached to the rod and the string forms a closed loop that is slightly longer than the distance from the attachment point to the upper end of the rod when the rod is suspended at the attachment point. In the case where the attachment point is a hole, the string will be threaded through the hole. A first weight is placed at a lower end of the rod to transfer a center of gravity location farther toward the lower end of the rod. The first weight will allow the wand to have a more controlled motion rather than oscillating or vibrating in an uncontrolled fashion.

A second weight may optionally be attached to the upper end of the rod to provide added mass in instances where the mass of the rod is insufficient allow controlled function of the levitating exercise wand. The mass of the levitating exercise wand (the rod, first weight and the second weight) will be from approximately 50 grams to approximately 100 grams. A levitating exercise wand with a lower mass will oscillate uncontrollably and a levitating exercise wand with a higher mass will cause the levitating exercise wand to respond sluggishly and clumsily to the exercise movements.

The method of exercise employing a levitating exercise wand begins with holding an arm with elbow bent at waist level and hand faced such that an index finger is placed topmost with all other fingers extended parallel and a thumb vertical. The string is placed at a midpoint of said index finger. The arm is moved forward and backward in a U-shaped motion around an upper end of said levitating exercise wand. The hand is held level and maintains the levitating wand in a vertical position.

The method of exercise may also employ dancing, and movements that will pass the levitating exercise wand around the body.

The levitating exercise wand will provide therapeutic movement to the deltoid, biceps, pectoral, and triceps muscles of the upper body, and to the rotator cuff, serratus, anterior, rhomboids, trapezius, and latismus dorsi of the lower and upper arms.

DETAILED DESCRIPTION OF THE INVENTION

Figure 1:
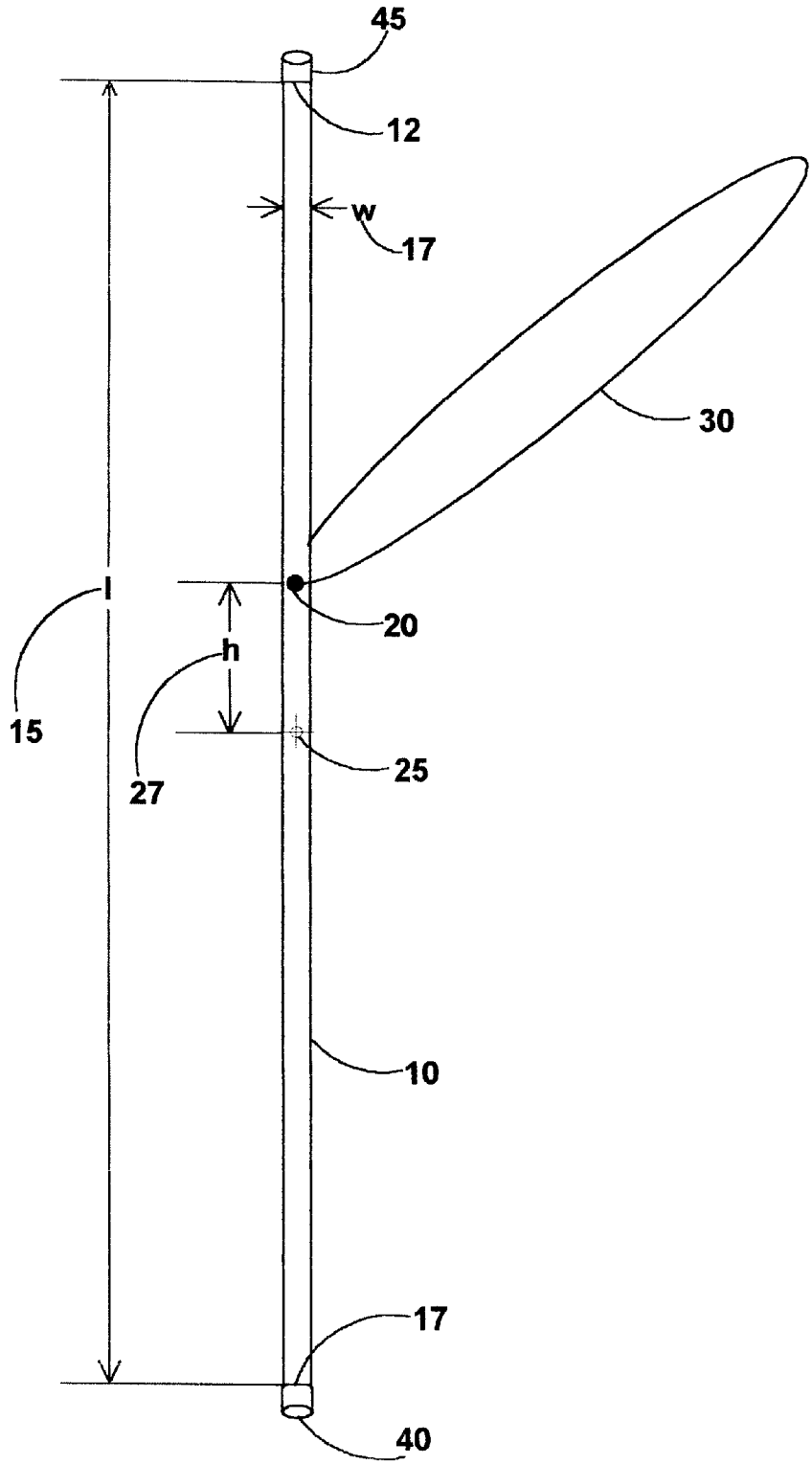
FIG. 1 is a drawing of the levitating exercise wand of this invention.

Refer now to FIG. 1 for a detailed description of the levitating exercise wand of this invention. A rod 10 of from approximately 45 cm. in length to approximately 125 cm. in length is provided. The rod 10 can be of materials such as wood, a metal such as aluminum, a plastic such as acrylic and polycarbonate, or glass. The rod 10 should be sufficiently lightweight so as to avoid inordinate stress of the muscles of the user and to prevent excess momentum in the wand during movement that will cause a sluggish clumsy feeling within the levitating exercise wand during exercise. The levitating exercise wand, however, should have sufficient mass to provide enough inertia to prevent uncontrolled swinging. The mass of the levitating exercise wand is preferably more than 50 grams and less than 100 grams. Any mass less than 50 grams will have an uncontrollable swinging or oscillation, and any mass greater than 100 grams will have the sluggish clumsy feeling described above.

A hole 20 is placed in the rod 10 to form an attachment point for a thread or string 30. The location of the hole 10 is a distance h 27 that is from approximately 1.9 cm. to approximately 3.0 cm. from the center of mass 22 of the rod 10. The hole 20 must have a diameter that is smaller than the cross-sectional dimension 17 of so as to maintain a vertical orientation of the rod 10 when in motion. The diameter of the hole 20 should also not effect the strength of the rod 10.

The thread or string 30 is threaded through the hole 20. The string 30 generally would be a lightweight monofilament nylon thread having sufficient strength to support the mass of the rod 10 and any additional stress caused during movement during the exercise motions. The string 30 is further fabricated of a material and in a fashion such that the string 30 is not susceptible to tangling. The string material can further be constructed of a natural grown fiber such as silk or cotton or may be of synthetic fibers such as nylon or polyester. The length of the string 30 should be long enough to pass over the upper end 12 of the rod 10.

A first weight 40 is added to the lower end 17 of the rod 10. The first weight 40 has a sufficient mass to prevent the lower end 17 of the rod 10 from swinging an uncontrolled fashion during movement. The first weight 40 as shown is separately attached to the rod 10. However, it is possible and in keeping with intent of this invention that the rod 10 and the first weight 40 is integrated to a single unit. In an implementation using a plastic rod, the weight could be placed in a mold as the wand is integrally formed.

In levitating exercise wands where the mass of the rod 10 and the first weight 40 is not sufficient to provide controlled motion, a second weight 45 may optionally be added to the upper end 12 of the rod 10. The mass of the first weight 40 and the second weight 45, when added to the mass of the rod 10, should be less than the 100 grams to prevent the clumsiness of the feel of the levitating exercise wand as described above. As with the first weight 40, the second weight 45 may be integrally formed with the rod 10.

Figure 2:
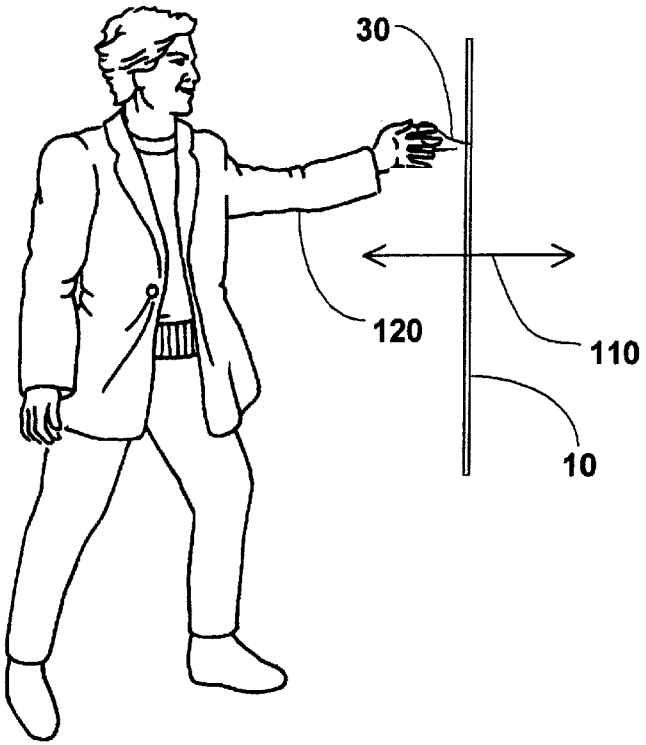
FIG. 2 is an illustration of a person performing the fundamental exercise method of this invention using a levitating exercise wand.

Refer now to FIG. 2. An operator holds chosen arm 120 out in front of body, elbow bent, at approximately waist level. Hand is held in a position in which the index finger is at the top, and the smallest finger at the bottom, fingers extended and held together, thumb up. The string 30 is draped over the hand, crossing over the index finger at the mid-point. With a slow and relaxed movement, the arm 120 is moved back and forth in a "U" pattern 110 around the upper end of the rod 10, with the tip of the rod 10 at the same level as that of the index finger. The rod 10 is kept in a vertical position at all times. The operator takes care not to let the hand touch the stick while in motion, as this would disturb the balance of the stick, and influence its verticality. As a variation, the operator may lift the arm up to bend at the shoulder level, elbow extended horizontally. Regular upper body movements originating at the waist will assist.

All of the movements described above may be incorporated interchangeably while swaying from the hips or dancing, forming a routine for exercise or a specific routine for therapy, such as that which may be employed by women recovering from radical mastectomy. The exercises as described above provide persons a gentle and consistent therapeutic strengthening of the deltoid, biceps, pectoral, and triceps muscles following surgery. Alternatively, for those persons with lymphoma, keeping the upper body moving and circulation moving is important.

Another variation involves extending a leg forward while passing the levitating exercise wand under from one hand to the other. Once the levitating exercise wand has been passed under the leg, the rod 10 returns to original position, maintaining a swaying or dancing motion while still moving the rod 10 in U-shaped 110 or circular movements.

By keeping the operating arm extended while maneuvering the rod 10 as described above, the operator therapeutically strengthens the deltoid, biceps, pectoral, and triceps muscles of the upper chest, as well as the rotator cuff, serratus anterior, rhomboid, trapezium, and latisimus dorsi muscles of the arm.

Improvement of hand-eye coordination may be expected from these routines, as well as better balance of body movements. Using both right and left arms distributes exercise evenly and engages both hemispheres of the brain. The gentle U-shaped motion 110 requires concentration and provides an excellent relaxing play tool for improving the attention span of persons with attention deficit disorder. Various other methods of keeping the levitating exercise wand in motion may also be employed, such as in passing it beneath the body, or under a leg while maintaining the rod in a controlled vertical position.

A second movement is executed with the string 30 held by index finger and thumb, hand tilting downward, and with rod 10 in a vertical position, a circular motion of the rod 10 may be perpetuated by lifting the elbow of the operating arm, while keeping arm extended, and allowing hand to pass beneath arm and back out in front of arm again. A rhythmic swaying of the body accompanying this movement will add animation and commence a workout. At any time, the operator may return to the U-shaped movements 110 previously described, and the circular and U-shaped movements 110 may be used interchangeably.

To facilitate a balanced workout, the operator should learn to pass the rod 10 from one hand to the other, and to become ambidextrously proficient in manipulating it.

Once ambidexterity has been achieved, the operator may initiate dance steps such as variations on the "twist" while moving the levitating exercise wand in the U-shaped motion 110.

Figure 3:
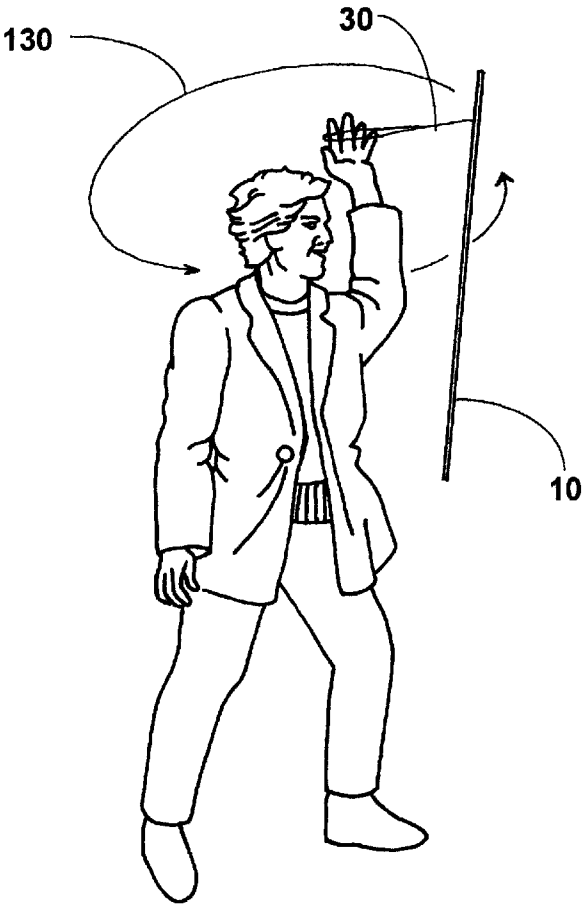
FIG. 3 is an illustration of a person performing an alternate motion of the method of exercise of this invention using the levitating exercise wand.

Refer now to FIG. 3 for another variant can be achieved by passing the rod 10 around the head and shoulders. This is done by raising the operating arm slightly above the head, holding the string 30 between thumb and index finger and, with rod 10 vertical, passing it in a circle around the upper body. A swaying movement of the body, from the hips, will animate this move.

While this invention has been particularly shown and described with reference to the preferred embodiments thereof, it will be understood by those skilled in the art that various changes in form and details may be made without departing from the spirit and scope of the invention.

What is claimed is:

1. A method of exercise employing a levitating exercise wand, comprising the steps of:

providing a levitating exercise wand whereby said levitating exercise wand comprises:

a rod having a constant diameter and with an attachment point at a point between a center of mass of said rod and an upper end of said rod such that the rod is maintained in a vertical orientation when in motion;

a string attached to said attachment point and forming a closed loop; and a first weighting means attached at a lower end of the rod to transfer a center of gravity location toward the lower end of said rod, whereby said lower end of the rod is a downward end of the rod when the rod is suspended from the string;

holding an arm with elbow bent at waist level and hand faced such that an index finger is placed topmost with all other fingers extended parallel and a thumb vertical;

placing the string at a midpoint of said index finger; and moving the arm forward and backward in a U-shaped motion around an upper end of said levitating exercise wand, holding the hand level and maintaining said levitating wand in a vertical position.

2. The method of claim 1 wherein said levitating exercise wand further comprises a second weighting means attached at the upper end of the rod to add mass to said levitating exercise wand to overcome a low mass of the rod.

3. The method of claim 1 further comprising the step of raising the arm such that the hand is at shoulder level while moving the hand forward and backward in the U-shaped motion.

4. The method of claim 1 further comprising executing dancing movements to enhance benefits of exercise with said levitating exercise wand.

5. The method of claim 1 wherein the attachment point for said rod is from approximately 1.9 cm to approximately 2.6 cm. from the center of mass of said rod.

* * * * *